US009695753B2

(12) United States Patent
Hoff et al.

(10) Patent No.: US 9,695,753 B2
(45) Date of Patent: Jul. 4, 2017

(54) OPERATOR CONTROL SYSTEM FOR MOTORCYCLE ENGINE IDLE

(71) Applicants: Vance A. Hoff, Grapeview, WA (US); Phillip G. Larson, Tahuya, WA (US); Perry D. Hoff, Grapeview, WA (US); Mark R. Hoff, Belfair, WA (US)

(72) Inventors: Vance A. Hoff, Grapeview, WA (US); Phillip G. Larson, Tahuya, WA (US); Perry D. Hoff, Grapeview, WA (US); Mark R. Hoff, Belfair, WA (US)

(73) Assignee: Old School Products LLC, Allyn, WA (US)

( * ) Notice: Subject to any disclaimer, the term of this patent is extended or adjusted under 35 U.S.C. 154(b) by 675 days.

(21) Appl. No.: 13/783,648

(22) Filed: Mar. 4, 2013

(65) Prior Publication Data

US 2013/0228153 A1 Sep. 5, 2013

Related U.S. Application Data

(60) Provisional application No. 61/634,521, filed on Mar. 2, 2012, provisional application No. 29/447,386, filed on Mar. 2, 2013.

(51) Int. Cl.
*F02D 9/02* (2006.01)
*F02D 9/10* (2006.01)

(52) U.S. Cl.
CPC ..... *F02D 9/02* (2013.01); *F02D 9/1055* (2013.01)

(58) Field of Classification Search
CPC ..... F02D 9/02; F02D 9/1055
USPC ..... 123/339.13
See application file for complete search history.

(56) References Cited

U.S. PATENT DOCUMENTS

| | | | | |
|---|---|---|---|---|
| 3,058,725 | A | 4/1958 | Manning | |
| 4,337,742 | A | 7/1982 | Carlson | |
| 4,558,765 | A * | 12/1985 | Hogan | 188/24.19 |
| 7,255,331 | B2 * | 8/2007 | Grant | 261/23.2 |
| 7,954,473 | B2 | 6/2011 | Ota | |
| 2004/0057463 | A1 * | 3/2004 | Fu | 370/469 |

(Continued)

OTHER PUBLICATIONS

Greer, Lloyd: Website screen capture from WayBackMachine, cited Apr. 14, 2010. Accessed Mar. 24, 2015. https://web.archive.org/web/20100414043130/http://www.lloydz.com/store/item_view.asp?estore_itemid=1000078.*

*Primary Examiner* — Joseph Dallo
(74) *Attorney, Agent, or Firm* — Puget Patent; Michael Gibbons

(57) ABSTRACT

An operator-controllable valve opens or closes an idle air bypass passage in a motorcycle, allowing an operator astride the motorcycle to set an idle position manually. A handle permits a first adjustment by the operator without use of a screwdriver or other hand tool. An additional interface enables a wider range of adjustment using a hand tool. Both interfaces vary depth of an air mixture screw of the valve within an idle air bypass passage of a throttle body. Dual cylindrical members of the valve rotate relative to one another and relative to a base of the valve, each cylindrical member driven by one of the interfaces. Locking the cylindrical members together such that both rotate in tandem upon the operator moving the handle is accomplished by either tightening the handle or tightening a nut coupling the handle to the valve. A handlebar adjustment lever may couple with the handle.

21 Claims, 13 Drawing Sheets

(56) References Cited

U.S. PATENT DOCUMENTS

| | | | | |
|---|---|---|---|---|
| 2009/0031986 | A1* | 2/2009 | Kaneko | 123/336 |
| 2010/0236469 | A1* | 9/2010 | Tsai | 116/167 |
| 2013/0228153 | A1* | 9/2013 | Hoff et al. | 123/339.13 |

* cited by examiner

FIG. 9c
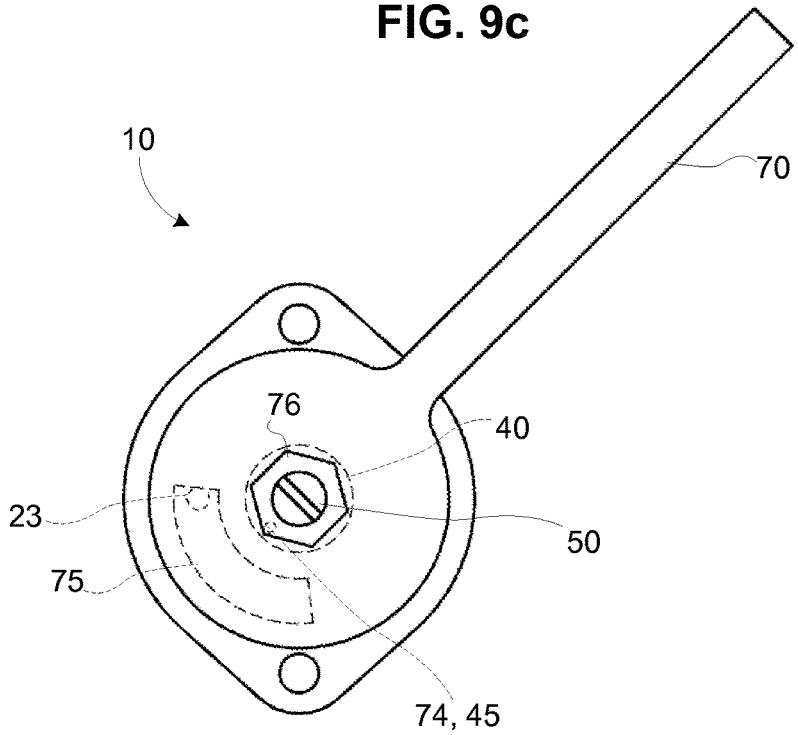
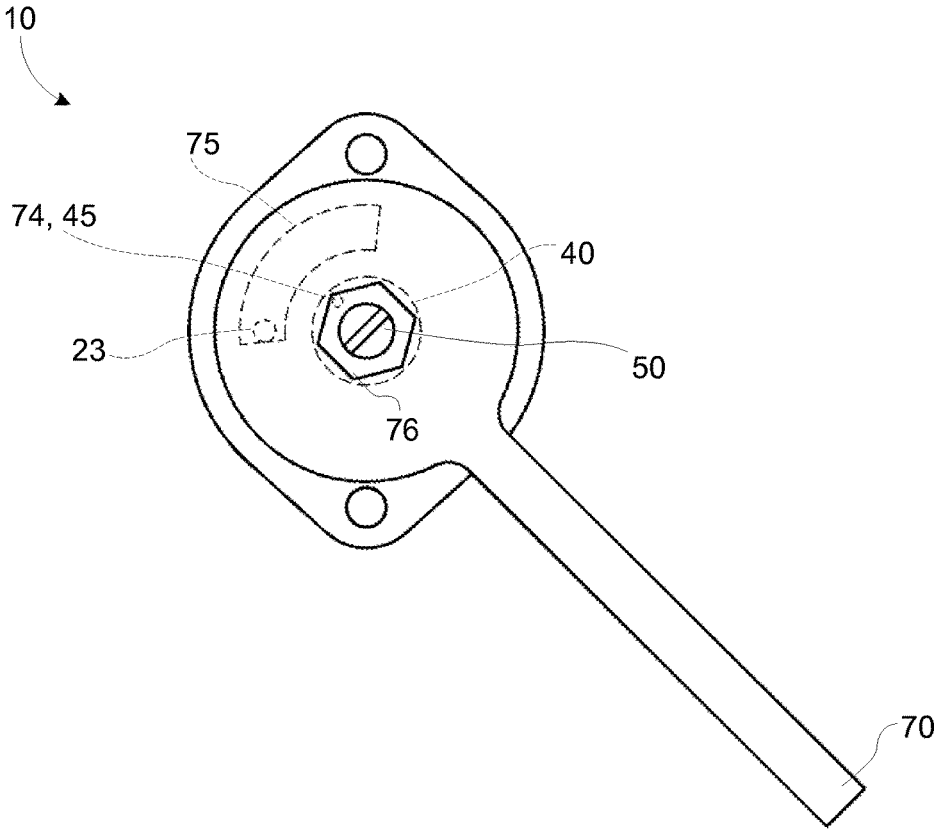
FIG. 9d

OPERATOR CONTROL SYSTEM FOR MOTORCYCLE ENGINE IDLE

PRIORITY CLAIM

This application claims priority from provisional application No. 61/634,521 filed Mar. 2, 2012, and from design patent application Ser. No. 29/447,386 filed Mar. 2, 2013. The foregoing applications are hereby incorporated by reference in their entirety as if fully set forth herein.

FIELD OF THE INVENTION

This invention relates generally to motorcycle engines, and more specifically, to an operator control system for motorcycle engine idle.

BACKGROUND

Vehicles utilizing an internal combustion engine, such as a motorcycle, have an idle configuration for phases where the engine operates but does not deliver power to the drivetrain. An engine may be idled by the operator, for example, immediately after starting the engine, while the vehicle is at rest or when the vehicle is coasting (i.e. at times when the engine is operating but is not engaged to the drivetrain of the vehicle).

Internal combustion engines operate through burning a mixture of fuel and air in a combustion chamber internal to the engine. Opening the throttle of an engine operates a valve (the "main throttle valve") within the throttle body controlling the volume of air flowing to the engine via a main air induction passage. Fuel is either drawn into the engine or injected into the engine in response to the induction of air, and combustion of the fuel and air occurs. When the engine is engaged with the drivetrain, the combustion powers the drivetrain of the vehicle to set the vehicle in motion in response to the open throttle.

At idle, even though the throttle is closed, sufficient fuel and air must remain available to the engine for it to continue to run smoothly while delivering sufficient power to accessories such as an alternator. Without any air, the combustion would be extinguished and the engine would stop. A common design therefore provides an idle air bypass passage as an alternative ingress of air to the engine when the operator closes the throttle.

Various performance characteristics of the engine are related to the ratio of air to fuel present during the combustion. Changing this ratio may, for example, vary the smoothness of engine operation including at different phases of operation (e.g. after startup), alter a sound profile of the engine, change engine operation in response to varied external atmospheric or temperature conditions, modify engine emissions or cause the engine to have differing wear-and-tear characteristics, among other results.

The ratio of air to fuel consumed by engines in factory-built vehicles is now commonly computer-controlled, as by an Engine Control Unit ("ECU"), to deliver a target ratio of air to fuel to the engine across a variety of phases of operation, including at idle. Particularly, upon switching from carbureted engines to fuel-injected engines, at least some motorcycle manufacturers eliminated the ability for an operator to adjust idle air volume, leaving this function solely to the ECU. Prior to the foregoing change, operator control of idle air in a motorcycle was possible via screwdriver adjustment of an air mixture screw.

Now, in a common engine at idle, the ECU determines a target idle air intake volume in response to various engine operating and/or extrinsic conditions and drives a stepper motor to control an idle air control valve that opens or closes the idle air bypass passage. U.S. Pat. No. 4,337,742 to Carlson et al. discloses one such idle air control apparatus, including a stepper motor and idle air control valve in a single device designed to be controlled by an ECU.

However, some motorcycle owners and operators of newer bikes may prefer to vary the air to fuel ratio at idle themselves, even if the motorcycle includes a factory ECU and stepper motor for controlling the idle air. Even more desirable for some enthusiasts is a means of at least partially varying the idle air by hand (i.e. without a screwdriver or other tool), and while astride the motorcycle.

Accordingly, what is disclosed is an operator control system for motorcycle engine idle.

SUMMARY

Embodiments involving operator control of motorcycle engine idle as disclosed herein may take different forms.

An exemplary system for operator control of motorcycle engine idle may include a manually-adjustable idle air control valve for a motorcycle, including at least: a base, the base including at least an adjusting lug channel, the adjusting lug channel disposed through the base including at least a threaded portion of the adjusting lug channel; an adjusting lug, the adjusting lug including at least: a threaded portion of the adjusting lug mating with the threaded portion of the adjusting lug channel of the base; and an air mixture screw channel disposed through the adjusting lug and coaxially disposed with the adjusting lug channel of the base, the air mixture screw channel including at least a threaded portion of the air mixture screw channel; an air mixture screw, the air mixture screw including at least: a threaded portion of the air mixture screw mating with the threaded portion of the air mixture screw channel of the adjusting lug; a bypass end; and an adjustment end opposite the bypass end, the adjustment end including at least an interface for a hand tool; and a handle, the handle interfaced with the adjusting lug.

Additional possible system features may include the air mixture screw adjustment end including at least an air mixture screw adjustment end including at least an interface for a hand tool, the interface for a hand tool enabling the air mixture screw to be rotated within the adjusting lug using a hand tool, the interface for a hand tool permitting at least two complete rotations of the air mixture screw within the adjusting lug; and wherein the handle interfaced with the adjusting lug includes at least a handle interfaced with the adjusting lug enabling the adjusting lug to be rotated within the base by hand, the handle limited to less than one rotation of the adjusting lug within the base.

Additional possible system features may include the adjusting lug including at least a threaded handle channel disposed through a side of the adjusting lug, and wherein the handle interfaced with the adjusting lug includes at least a threaded end, the threaded end of the handle mating with the threaded handle channel of the adjusting lug; and a grip end, the grip end opposite the threaded end, the grip end including at least the interface for a hand tool, wherein the handle limits the rotation of the air mixture screw within the adjusting lug upon threading the handle through the threaded handle channel of the adjusting lug until the handle fixedly engages the air mixture screw.

Additional possible system features may include the adjusting lug including at least a handle-interfacing post, the handle interfacing post disposed on a top surface of the adjusting lug; wherein the handle interfaced with the adjusting lug includes at least a center aperture of the handle, wherein a threaded portion of the air mixture screw adjustment end is disposed through the center aperture of the handle; a dimple disposed on a bottom surface of the handle, the dimple engaging the handle-interfacing post of the adjusting lug; and an arcuate hollow on the bottom surface of the handle; and wherein a nut threaded onto the threaded portion of the air mixture screw adjustment end fixedly couples the handle and adjusting lug and engages the arcuate hollow with a roll pin disposed on a top surface of the base, the roll pin and arcuate hollow limiting rotation of the handle to less than one rotation of the adjusting lug within the base.

Additional possible system features may include the base including at least a bottom surface of the base; a top surface of the base; a bottom circular collar disposed adjacent to the bottom surface of the base, the bottom circular including at least a bottom aperture of the bottom circular collar; and a top circular collar disposed adjacent to the top surface of the base, the top circular collar including at least a top aperture of the top circular collar, wherein the adjusting lug channel is coaxially disposed through the top circular collar, the base, and the bottom circular collar, the adjusting lug channel including at least the threaded portion of the adjusting lug channel including at least a bottom aperture collocated with the bottom aperture of the bottom circular collar; and a non-threaded portion of the adjusting lug channel, the non-threaded portion of the adjusting lug channel including at least a top aperture collocated with the top aperture of the top circular collar, wherein the non-threaded portion of the adjusting lug channel has a diameter greater than a diameter of the threaded portion, the threaded portion and non-threaded portion joined at a shelf portion of the adjusting lug channel, the shelf portion defining a limit for the rotation of the adjusting lug within the adjusting lug channel.

Additional possible system features may include the top circular collar disposed adjacent to the top surface of the base including at least a top circular collar disposed adjacent to the top surface of the base, wherein at least an arcuate portion of the top circular collar is cut away defining a C-shaped region of the top circular collar, the C-shaped region of the top circular collar defining two shoulders disposed at opposite ends of the C-shaped region, the two shoulders limiting rotation of the handle to less than one rotation.

Additional possible system features may include the adjusting lug including at least a non-threaded portion of the adjusting lug, the non-threaded portion of the adjusting lug and the threaded portion of the adjusting lug joined at a shelf portion of the adjusting lug, wherein the non-threaded portion of the adjusting lug is at least partially disposed within the non-threaded portion of the adjusting lug channel when the adjusting lug is threaded into the adjusting lug channel of the base, wherein an adjusting lug o-ring is disposed around the threaded portion of the adjusting lug adjacent to the shelf portion of the adjusting lug, and wherein the shelf of the adjusting lug encounters the adjusting lug o-ring and the shelf of the adjusting lug channel of the base to limit the rotation of the adjusting lug within the adjusting lug channel of the base.

Additional possible system features may include the air mixture screw including at least a non-threaded portion disposed between the threaded portion and the bypass end, wherein the non-threaded portion has a diameter greater than a diameter of the threaded portion, the threaded portion and non-threaded portion joined at a limit portion of the air mixture screw, the limit portion defining a limit for the rotation of the air mixture screw within the air mixture screw channel of the adjusting lug, wherein an air mixture screw o-ring is disposed around the non-threaded portion of the air mixture screw.

Additional possible system features may include the threaded portion of the air mixture screw including at least the threaded portion of the air mixture screw including at least a portion of the threads removed from an interior region of the threaded portion. Additional possible system features may include the bypass end of the air mixture screw including at least a bypass end of the air mixture screw including at least a tip, the tip comprising a portion of the bypass end with a larger diameter than an adjacent portion of the air mixture screw, wherein at least a portion of the tip is a flat surface. Additional possible system features may include the tip of the air mixture screw including at least a flared portion of the tip.

Additional possible system features may include the air mixture screw o-ring disposed around the non-threaded portion of the air mixture screw at least substantially contacts an interior portion of the air mixture screw channel of the adjusting lug around a circumference of the interior portion of the air mixture screw channel, and wherein the adjusting lug o-ring disposed around the threaded portion of the adjusting lug at least substantially contacts an interior region of the adjusting lug channel of the base around a circumference of the interior portion of the adjusting lug channel.

Additional possible system features may include the manually-controllable idle air control valve including at least a torsion return spring, the torsion return spring wound around the adjusting lug, the torsion return spring coupled to the handle and the base and tensionally biasing the handle and adjusting lug in a first position of the idle air control valve; a handlebar control; and a cable disposed through the handlebar control and coupled with the handle, wherein applying hand pressure to the handlebar control pulls the cable coupled with the handle to rotate the adjusting lug to a second position of the idle air control valve, and wherein releasing hand pressure from the handlebar control releases the cable coupled with the handle, the torsion return spring tensionally biasing the handle and adjusting lug to the first position of the idle air control valve.

Another exemplary system for operator control of motorcycle engine idle may include an apparatus for operator control of motorcycle engine idle, including at least: an idle air control device configured for controlling airflow through an idle air bypass passage; a handle coupled to the idle air control device, the handle enabling a human to at least partially vary a first range of the idle air control device by hand; and an interface of the idle air control device for a hand tool, the interface of the idle air control device for a hand tool enabling a human to at least partially vary a second range of the idle air control device.

Additional possible system features may include the handle coupled to the idle air control device, the handle enabling a human to at least partially vary a first range of the idle air control device by hand including at least: a handle coupled to the idle air control device, the handle enabling an operator of the motorcycle to at least partially vary a first range of the idle air control device by hand while astride the motorcycle. Additional possible system features may include the first range of the idle air control device is a smaller range than the second range of the idle air control device. Additional possible system features may include the handle enabling a human to vary a first range of the idle air control device; and the interface for a hand tool enabling a human to vary a second range of the idle air control device, wherein the varying of the idle air control device occurs without command of the idle air control device by an ECU of the motorcycle. Additional possible system features may include at least one of varying the first range of the idle air control or the second range of the idle air control is at least partially commanded by an ECU of the motorcycle.

Another exemplary system for operator control of motorcycle engine idle may include an apparatus for controlling the depth of an externally-threaded air mixture screw, including at least a cylindrical member, the cylindrical member having a hollow interior, the hollow interior configured for threadably receiving the air mixture screw, wherein at least a portion of the cylindrical member has a threaded exterior; and a base, the base configured to be fixedly positioned adjacent to the exterior of a throttle body, the base having a threaded aperture disposed through the base for receiving the threaded exterior portion of the cylindrical member, wherein the air mixture screw, cylindrical member and threaded aperture of the base are coaxial to one another and wherein the air mixture screw and cylindrical member threadably rotate relative to one another and to the base to vary the depth of the air mixture screw within the throttle body, and wherein at least one of the threadably coupled air mixture screw and cylindrical member or the threadably coupled cylindrical member and base are configured for being fixedly threadably coupled to one another.

Additional possible system features may include at least one of the air mixture screw or cylindrical member is hand-adjustable by an operator of a vehicle astride the vehicle. Additional possible system features may include the at least one of the threadably coupled air mixture screw and cylindrical member or the threadably coupled cylindrical member and base that are configured for being fixedly threadably coupled to one another including at least one of the threadably coupled air mixture screw and cylindrical member or the threadably coupled cylindrical member and base that are configured for being fixedly coupled to one another by a human using a hand tool.

In addition to the foregoing, various other system embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or other subject matter described herein will become apparent in the teachings set forth herein.

BRIEF DESCRIPTION OF THE DRAWINGS

Certain embodiments of the present invention are described in detail below with reference to the following drawings:

FIGS. 9*c* and 9*d* are top plan views of an apparatus for operator control of motorcycle engine idle, in accordance with an embodiment of the invention.

DETAILED DESCRIPTION

This invention relates generally to motorcycle engines, and more specifically, to an operator control system for motorcycle engine idle. Specific details of certain embodiments of the invention are set forth in the following description and in FIGS. 1-10 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
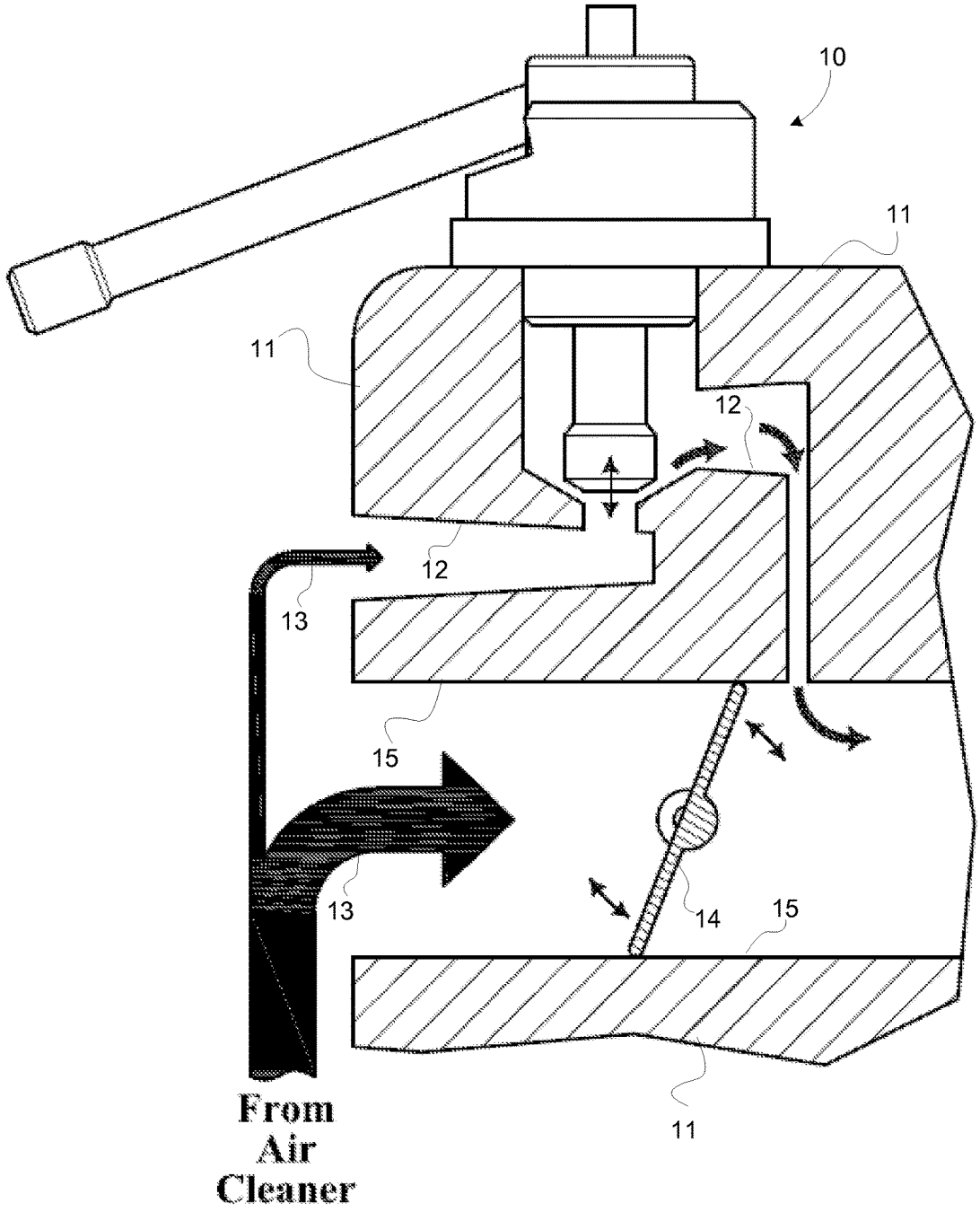
FIG. 1 is a cutaway view of an exemplary throttle body with which an operator control system for motorcycle engine idle is coupled, in accordance with an embodiment of the invention.

FIG. 1 is a cutaway view of an exemplary throttle body with which an operator control system for motorcycle engine idle is coupled, in accordance with an embodiment of the invention. A throttle body 11 of an internal combustion engine may include a main air induction passage 15 and an idle air bypass channel 12. A main throttle valve 14 is controlled by the operator engaging or disengaging a throttle lever on the handlebar of the motorcycle (not shown). Opening the main throttle valve permits air from an air cleaner 13 to flow through the throttle body via the main air induction passage. At idle, when the main throttle valve is substantially closed, air flows through the throttle body via an idle air bypass channel 12. The amount of air is metered by the apparatus 10, in accordance with various exemplary embodiments described herein.

Figure 2:
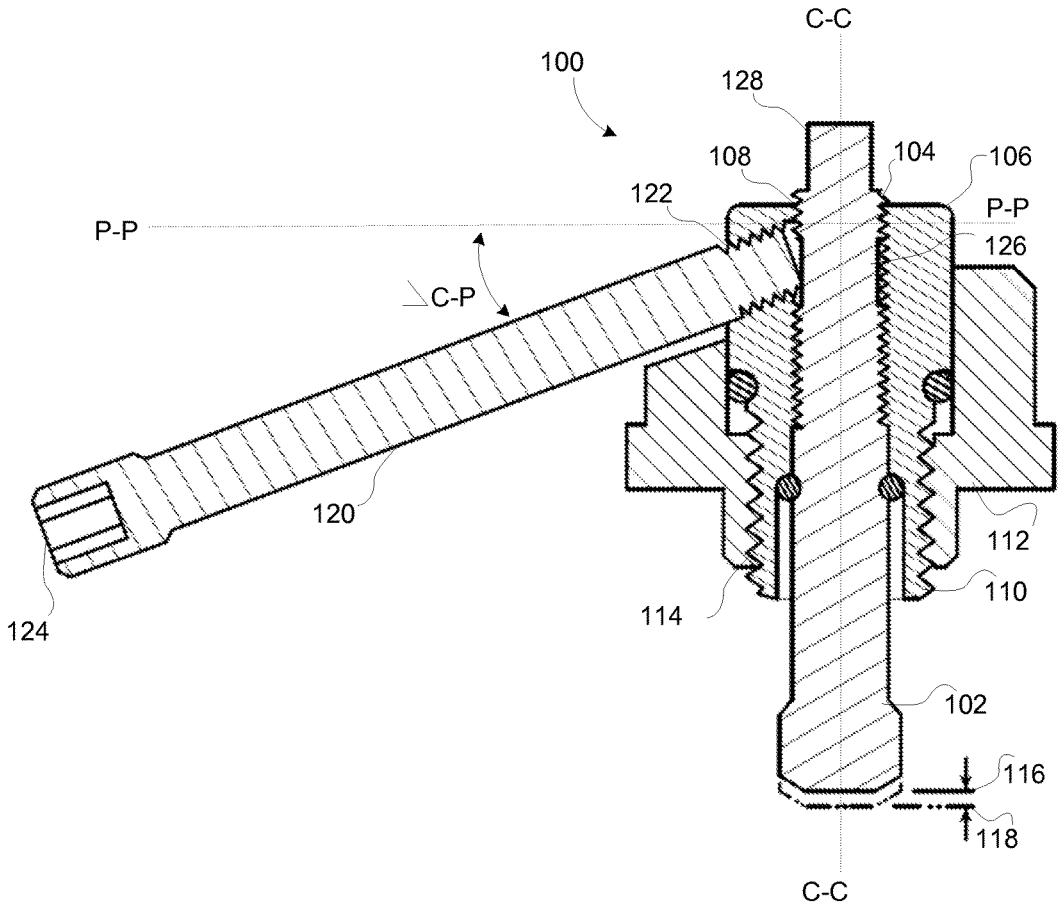
FIG. 2 is a cross-sectional view of an operator control system for motorcycle engine idle, in accordance with an embodiment of the invention.

FIG. 2 is a cross-sectional view of an operator control system for motorcycle engine idle, in accordance with an embodiment of the invention. In some embodiments, an operator control system for motorcycle engine idle comprises an apparatus 100 for controlling the depth of an externally-threaded air mixture screw 102. The apparatus includes a base 112, the base configured to be fixedly positioned adjacent to the exterior of a throttle body (throttle body not shown in FIG. 2 but depicted in FIG. 1 as throttle body 11). In some embodiments, the base may have mounting channels disposed through the base (mounting channels not shown in FIG. 2) facilitating coupling of the base with the throttle body using fasteners, such as threaded fasteners passing through the base that lockibly engage with the throttle body to hold the base against the throttle body. In different embodiments, the base is sandwiched between a bracket (bracket not shown) and the throttle body, and fasteners are used to keep the bracket, base and throttle body attached to one another. The bracket at least partially covering the base would have an aperture permitting a portion of the apparatus to be accessible to an operator.

In some embodiments, the apparatus 100 receives an air mixture screw 102. Features of the apparatus vary the depth of the air mixture screw within the throttle body. At a first depth 116, the air mixture screw permits air to pass below the air mixture screw and through the idle air bypass channel (not shown in FIG. 2 but depicted as idle air bypass channel 12 in FIG. 1). At a second depth 118, the air mixture screw may come substantially into contact with the throttle body at the idle air bypass channel, closing the idle air bypass channel. The apparatus has at least two means of operator control of the depth of the air mixture screw within the throttle body, and depths other than the foregoing first and second depths may be set.

In some embodiments, the air mixture screw 102 has external threads, the external threads disposed along at least a portion of the shaft of the air mixture screw such as the externally threaded portion 104 of the air mixture screw. The air mixture screw is rotatably threaded into a cylindrical member 106 of the apparatus 100, the cylindrical member having a hollow interior. A portion of the hollow interior is threaded at 108, the hollow interior thus configured for threadably receiving the air mixture screw. In some embodiments, the cylindrical member 106 may also have an exterior portion of the cylindrical member that is threaded, such as the portion of the cylindrical member 110.

The base 112 of the apparatus 100 has a threaded aperture disposed through the base 114, the threaded aperture disposed through the base configured for receiving the cylindrical member 106 via the portion of the cylindrical member having a threaded exterior 110 being rotatably threaded into the threaded aperture disposed through the base. The air mixture screw 102 when rotatably threaded into the cylindrical member is coaxial to the hollow interior of the cylindrical member, and the cylindrical member when rotatably threaded into the base is coaxial to the threaded aperture of the base, the coaxial axis depicted as C-C in FIG. 2. Consequently, the air mixture screw is also coaxial to the threaded aperture of the base. It may also be seen that the air mixture screw threadably rotates relative to the cylindrical member and relative to the threaded aperture of the base, and further that the cylindrical member having received the air mixture screw may rotate relative to the threaded aperture of the base. Thus, depth of the air mixture screw within the throttle body may be varied by rotating the air mixture screw or by rotating the cylindrical member having received the air mixture screw.

In some embodiments, at least one of the air mixture screw 102 or the cylindrical member 106 may be rotated by an operator of the motorcycle by hand while sitting astride the motorcycle. For example, the apparatus 100 may include a hand-adjustment member 120. In some embodiments, the hand-adjustment member may rotate the cylindrical member via the hand-adjustment member being threaded into the cylindrical member at 122, the rotation of the cylindrical member facilitating variation of the depth of the air mixture screw 102 within the throttle body. In some embodiments, the hand-adjustment member is threaded into the cylindrical member substantially perpendicularly to the coaxial orientation of the air mixture screw, cylindrical member and threaded aperture of the base (depicted as perpendicular line P-P in FIG. 2). In further embodiments, the hand-adjustment member may be off the perpendicular, including a range from 1 degree from the perpendicular to 89 degrees from the perpendicular. In a preferred embodiment, the hand-adjustment member is on or about 20 degrees below the perpendicular (depicted as angle C-P in FIG. 2). The hand-adjustment member is positioned within reach of the operator of the motorcycle astride the motorcycle, owing to the position of the apparatus and its mounting to the throttle body on the side of the motorcycle below its fuel tank.

In different embodiments, the hand-adjustment member 120 may couple with the air mixture screw 102 rather than the cylindrical member 106. In some embodiments, the travel of the cylindrical member within the base 112 using the hand-adjustment member 120 is limited to less than one rotation of the cylindrical member. In a preferred embodiment, the hand-adjustment member is limited to 90 degrees of rotation of the cylindrical member about the coaxial. However, it may be seen that when the hand-adjustment member is not threaded into the cylindrical member, the cylindrical member may be threaded into the base permitting more than one rotation of the cylindrical member.

In some embodiments, at least one of the air mixture screw 102 or the cylindrical member 106 may be rotated by a human using a hand tool. For example, the apparatus 100 may include a hand-tool interface of the air mixture screw 128. In some embodiments, a hand tool (not shown) engaged with the hand-tool interface of the air mixture screw may facilitate rotating the air mixture screw within at least one of the cylindrical member or the base 112 to vary the depth of the air mixture screw within the throttle body. It may be seen that the air mixture screw may be rotated including more than one rotation of the air mixture screw.

It may be advantageous to configure a first depth of the air mixture screw 102 (a "major adjustment"), and then to lockibly engage portions of the apparatus and/or the air mixture screw while still permitting other portions of the apparatus and/or the air mixture screw to at least partially rotate relative to one another varying the depth of the air mixture screw over a limited range (a "minor adjustment"). Accordingly, in certain embodiments, at least one of the threadably coupled air mixture screw 102 and cylindrical member 106 or the threadably coupled cylindrical member and base 112 are configured for being fixedly threadably coupled to one another. In an exemplary embodiment, a portion of the air mixture screw shaft has threads removed to define a non-threaded portion of the air mixture screw 126. The hand-adjustment member 120 may be threaded into the circular member 106 via a threaded portion of the hand-adjustment member 122. In some embodiments, a hand tool (not shown) may be used to tighten the hand-adjustment member against the non-threaded portion of the air mixture screw, via the hand tool engaging a hand tool interface of the hand-adjustment member 124. Rotatably threading the hand-adjustment member into the circular member at 122 until the end of the hand-adjustment member opposite the hand tool interface engages and locks the air mixture screw with the hand-adjustment member. Accordingly, the threadably coupled air mixture screw and cylindrical member become fixedly threadably coupled to one another, so that the hand-adjustment member, when engaged by an operator of the motorcycle, moves the cylindrical member and the air mixture screw in tandem. Combined with the limited travel of the hand-adjustment member serving to limit the rotation of the cylindrical member, the range of travel of the air mixture screw, and thus its depth within the throttle body, is limited to a range corresponding with the limited travel of the hand-adjustment member (the "minor adjustment" range). The foregoing describes the cylindrical member and air mixture screw being fixedly threadably coupled to one another. In different embodiments, the cylindrical member of the apparatus 100 and base of the apparatus may be fixedly threadably coupled to one another such that only the air mixture screw is rotatable within the apparatus.

When the hand-adjustment member 120 is disengaged from the air mixture screw 102 (which may be accomplished by rotatably unthreading the hand-adjustment member from the cylindrical member 106 out of the aperture through the side of the cylindrical member at 122), the air mixture screw may be rotated through a full range of revolutions, facilitating the movement of the air mixture screw through a wider range of depths within the throttle body (the "major adjustment" range) than is possible by operating the hand-adjustment member alone. The major adjustment may be accomplished before locking the hand-adjustment member and cylindrical member by engaging a hand tool with the hand-tool interface of the air mixture screw as described above. It may be seen that setting the major adjustment range of the air mixture screw utilizing a hand tool comprises a first means of controlling the depth of the air mixture screw within the throttle body, and that setting the minor adjustment range of the air mixture screw through engaging the hand-adjustment member by hand comprises a second means of controlling the depth of the air mixture screw within the throttle body.

Figure 3A:
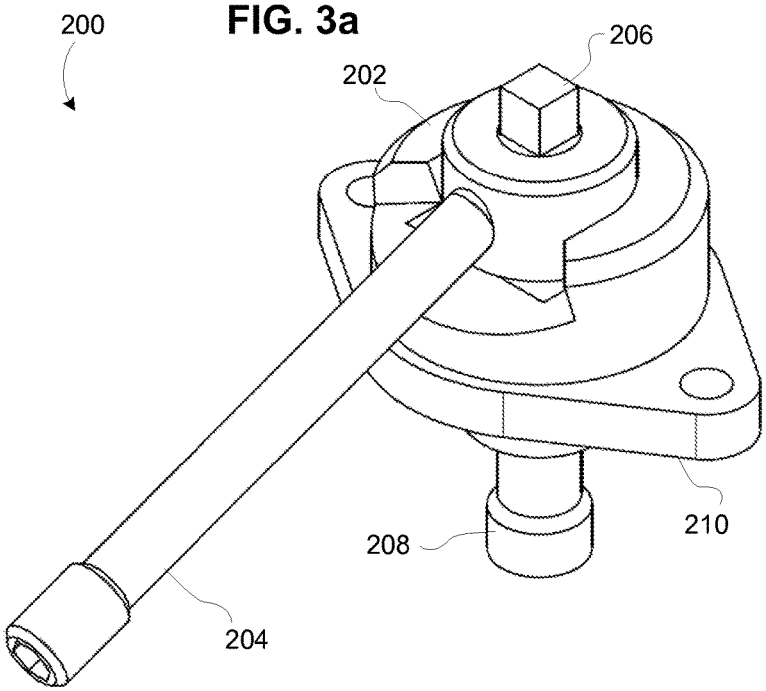
FIG. 3*a* is an isometric view of an apparatus for operator control of motorcycle engine idle, in accordance with an embodiment of the invention.
Figure 3B:
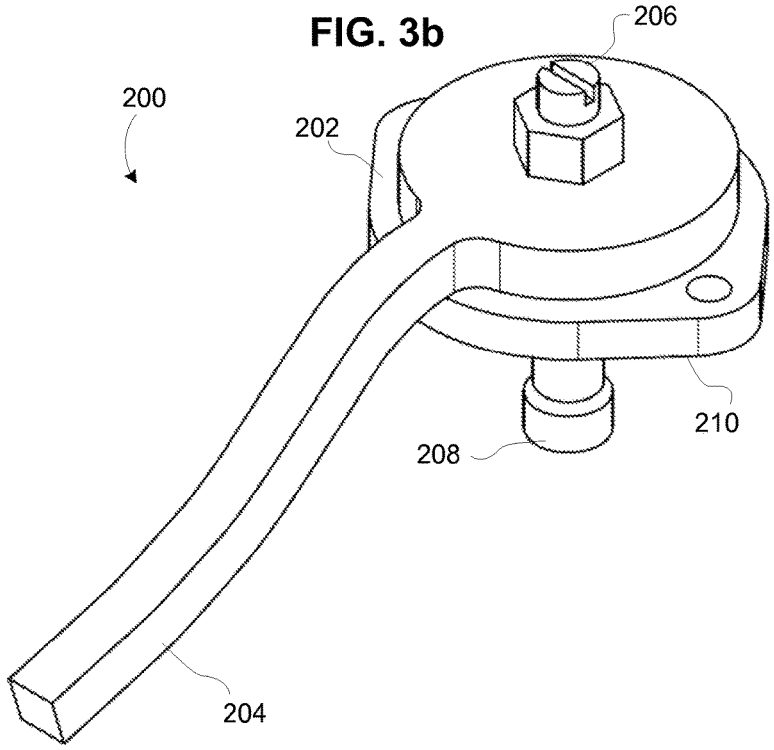
FIG. 3*b* is an isometric view of an apparatus for operator control of motorcycle engine idle, in accordance with an embodiment of the invention.

FIG. 3*a* is an isometric view of an apparatus for operator control of motorcycle engine idle, in accordance with an embodiment of the invention. FIG. 3*b* is an isometric view of an apparatus for operator control of motorcycle engine idle, in accordance with an embodiment of the invention. In some embodiments, an apparatus for operator control of motorcycle engine idle 200 includes an idle air control device 202, the idle air control device configured for controlling airflow through an idle air bypass passage (idle air bypass passage not shown in FIGS. 3*a* and 3*b* but depicted as idle air bypass passage 12 in FIG. 1). In some embodiments, the idle air control device may include a plunger 208 that extends and retracts from a bottom surface 210 of the idle air control device, varying the extension of the plunger into an idle air bypass passage to control the airflow through the passage. Operation of the plunger may be controlled by handle 204 coupled with the idle air control device 202, or by the interface for a hand tool 206 of the idle air control device 202.

Figure 4A:
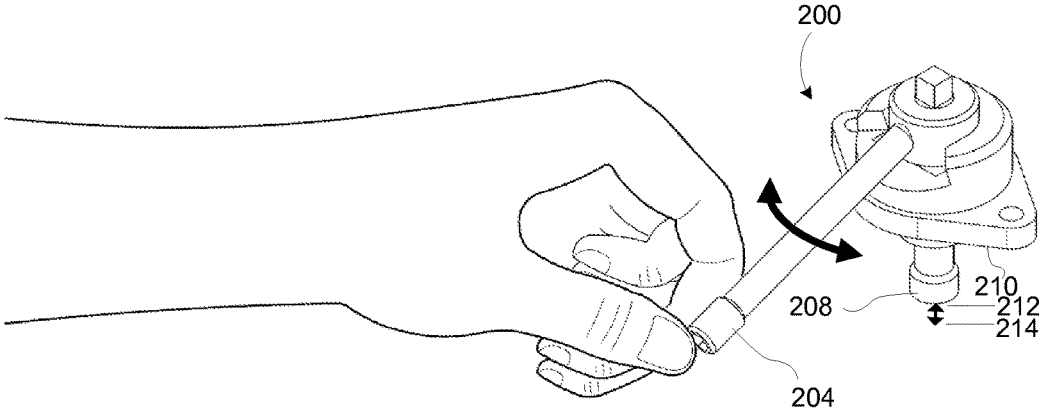
FIGS. 4*a* and 4*b* are isometric views of an apparatus for operator control of motorcycle engine idle, in accordance with an embodiment of the invention.
Figure 4B:
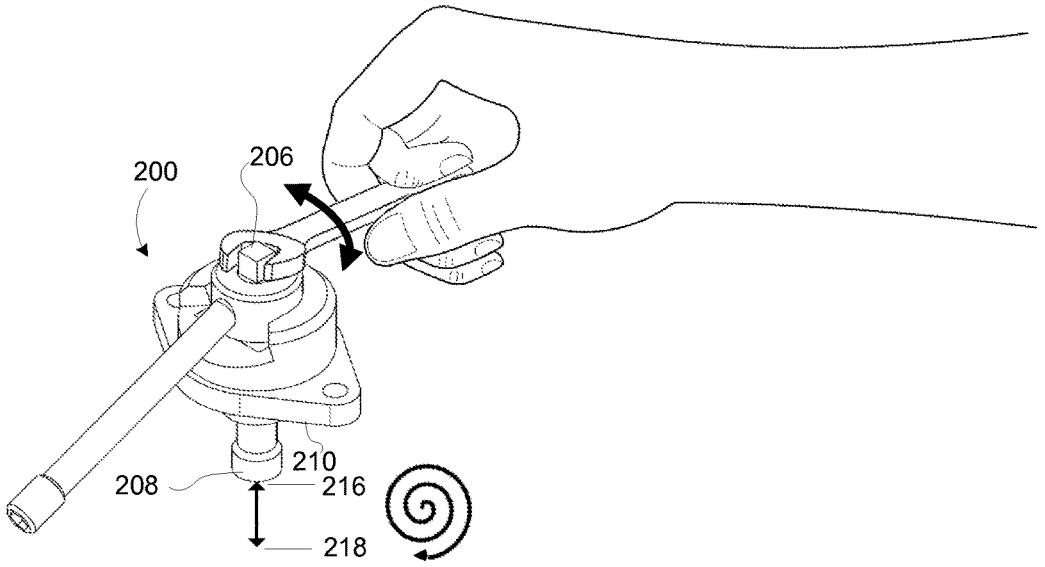

FIGS. 4*a* and 4*b* are isometric views of an apparatus for operator control of motorcycle engine idle, in accordance with an embodiment of the invention. FIG. 4*a* depicts handle 204 of the apparatus 200 being rotated by hand. The handle may be operated by a human and enables the human to vary a first range of the idle air control device by hand. Rotation in one direction extends the plunger 208 from the bottom surface 210 of the idle air control device. Rotation in the opposite direction retracts the plunger towards the bottom surface and into the idle air control device. The range of rotation of the handle may be limited, as for example by the configuration of the apparatus, to 90 degrees of rotation, resulting in a first range of extension of the plunger from a top of the first range at 212 (retracted) to a bottom of the first range at 214 (extended). FIG. 4*b* depicts the interface for a hand tool 206 being engaged by a hand tool (a wrench) controlled by a human. The interface for a hand tool enables a human to use a hand tool to vary a second range of the idle air control device. Turning the hand tool engaged with the interface for a hand tool in one direction extends the plunger 208 from the bottom surface of the idle air control device. Turning the hand tool in the opposite direction retracts the plunger towards the bottom surface and into the idle air control device. The interface for a hand tool may be rotated more than one rotation, resulting in a second range of extension of the plunger from a top of the second range at 216 (retracted) to a bottom of the second range at 218 (extended). In a preferred embodiment, the range of plunger travel of the second range is larger than the range of plunger travel of the first range (i.e. the first range of the idle air control device is a smaller range than the second range of the idle air control device). In some embodiments, the handle enables an operator to at least partially vary a first range of the idle air control device by hand while the operator is astride the motorcycle. In a preferred embodiment, the idle air control device is installed on the motorcycle on the side of the motorcycle below a fuel tank where it is accessible to the operator while astride the motorcycle. In a further preferred embodiment, the idle air control device has no circuitry, and varying of the idle air control device occurs without being commanded by an ECU of the motorcycle. In a different embodiment, the idle air control device is at least partially coupled with an ECU of the motorcycle, and at least one of varying the first range of the idle air control or the second range of the idle air control is at least partially commanded by the ECU of the motorcycle. For example, in some embodiments an ECU may set a first idle air control setting which is variable by a human within a range governed by the ECU.

In some embodiments, the idle air control device may include threaded members that rotate relative to one another. In further embodiments, the threads of one coupling of threaded members may be finer or coarser than those of a different coupling of threaded members, such differently threaded couplings of threaded members further facilitating differing ranges of plunger travel.

Figure 5A:
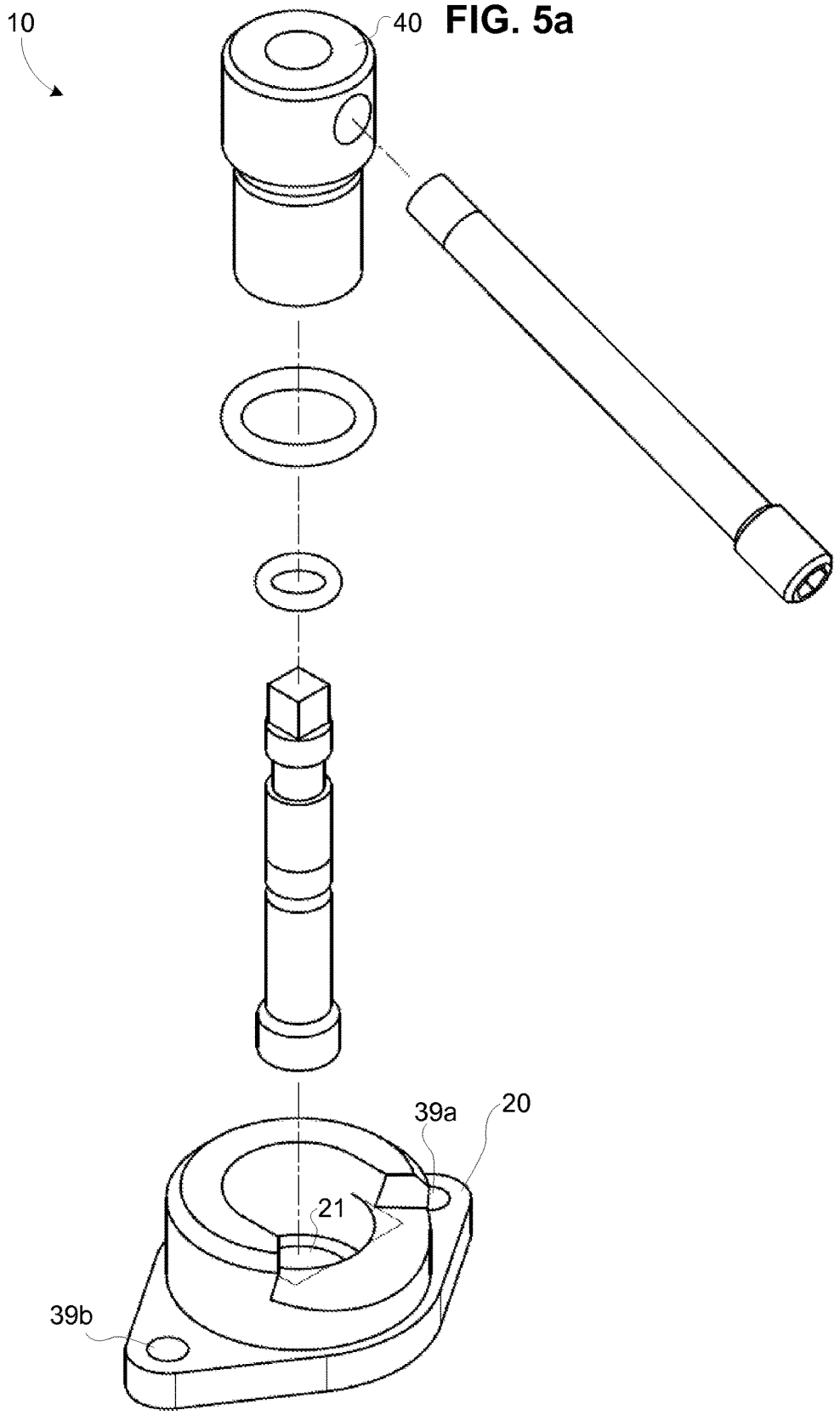
FIGS. 5*a*, 5*b* and 5*c* are an exploded view, a cross-sectional view and a top plan view of an apparatus for operator control of motorcycle engine idle, in accordance with an embodiment of the invention.
Figure 5B:
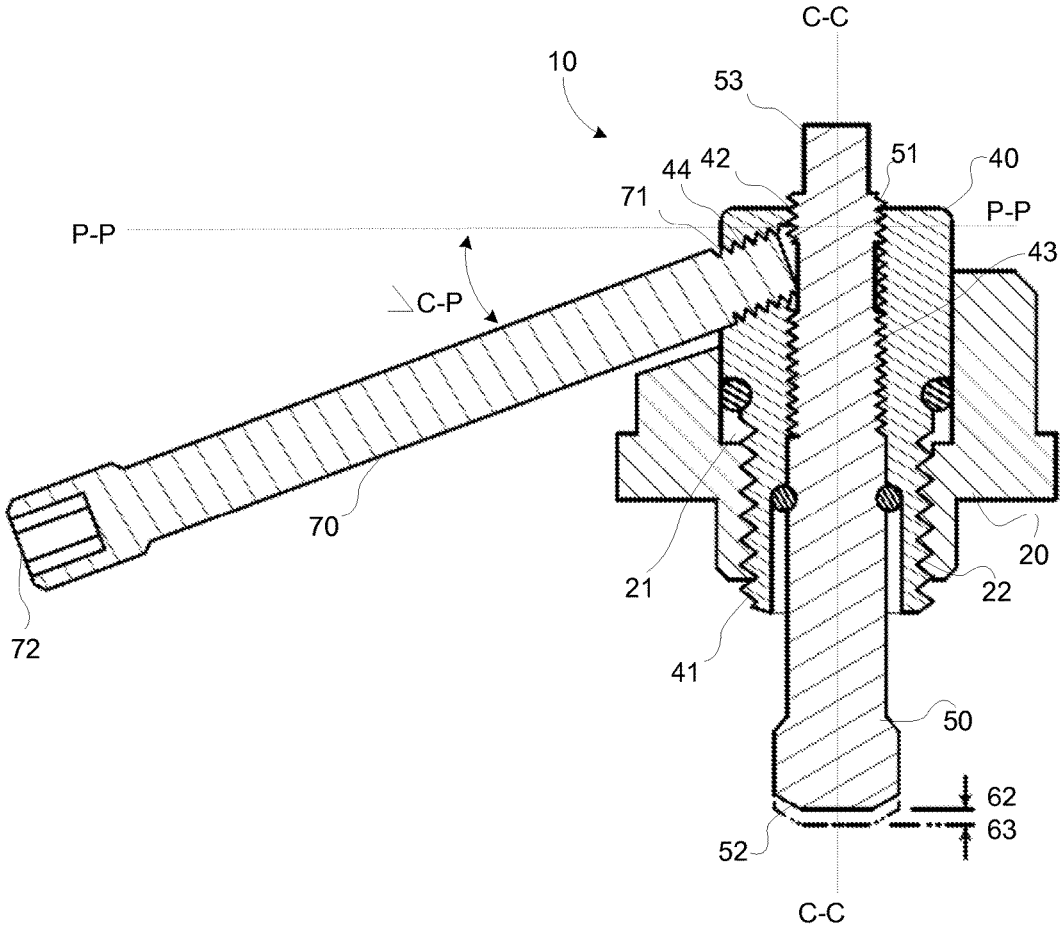
Figure 5C:
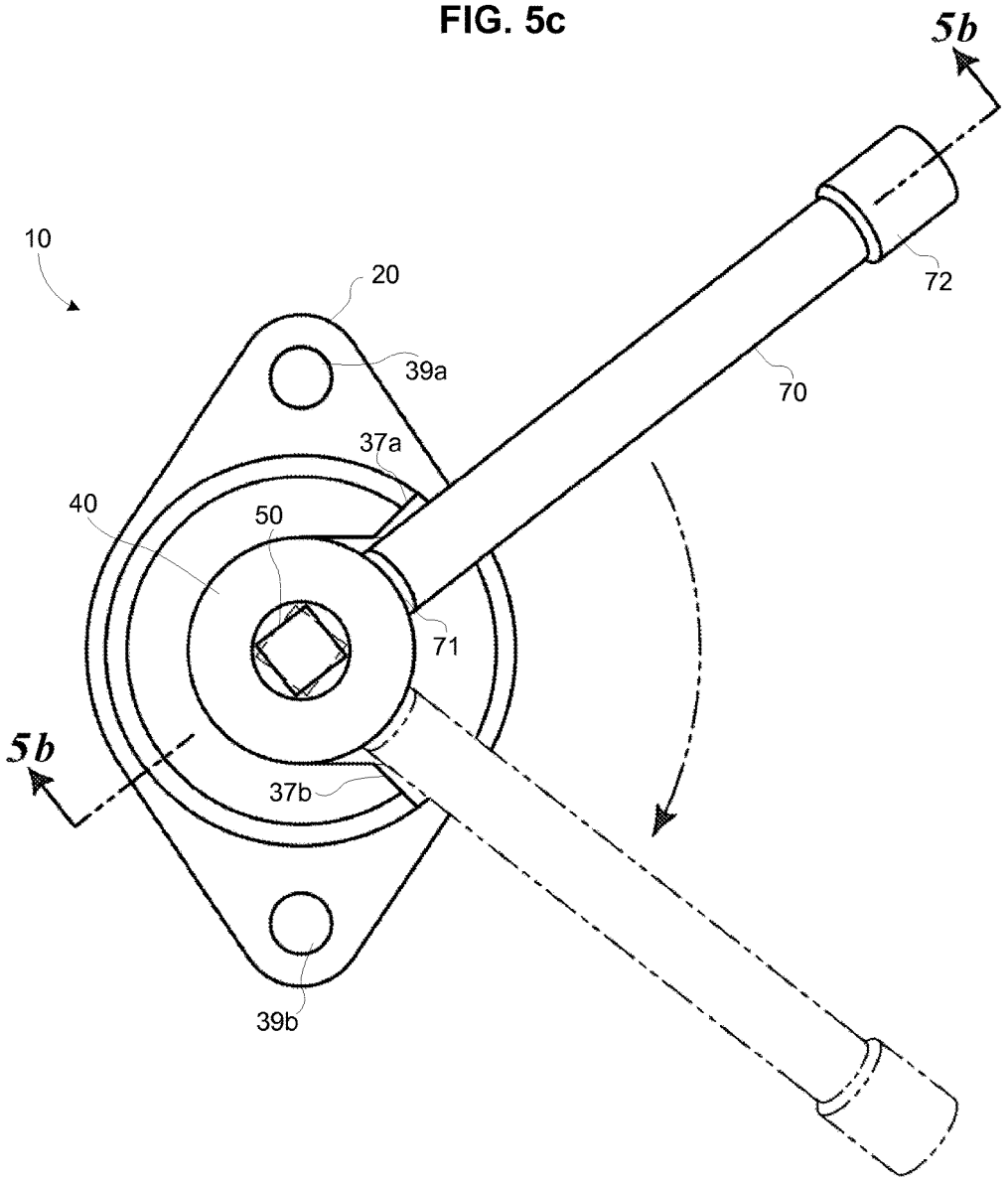

FIGS. 5*a*, 5*b* and 5*c* are an exploded view, a cross-sectional view and a top plan view of an apparatus for operator control of motorcycle engine idle, in accordance with an embodiment of the invention. In some embodiments, an apparatus for operator control of motorcycle engine idle comprises a manually-adjustable idle air control valve for a motorcycle 10. Valve 10 may include a base 20, an adjusting lug 40, an air mixture screw 50 and a handle 70. (FIGS. 5*a* and 5*b* depict the same embodiment including the aforementioned four elements; however, threads are not depicted on the components in FIG. 5*a* for extra visibility of the figure. Threads are shown on the components in the cross-sectional view in FIG. 5*b* and should be understood to be a part of the components in FIG. 5*a*.)

The base 20 is adapted to be coupled with a throttle body (throttle body not shown in FIGS. 5*a*, 5*b* and 5*c* but depicted in FIG. 1 as throttle body 11). The base is configured to be fixedly positioned adjacent to the exterior of the throttle body. In some embodiments, the base may have one or more mounting channels 39*a* and 39*b* disposed through the base facilitating coupling of the base with the throttle body using fasteners (fasteners not shown), such as threaded fasteners passing through the base that lockibly engage with the throttle body to hold the base against the throttle body. In different embodiments, the base (which may or may not include mounting channels) is sandwiched between a bracket (bracket not shown) and the throttle body, and fasteners are used to keep the bracket, base and throttle body coupled. The bracket at least partially covering the base would have an aperture permitting a portion of the apparatus to be accessible to an operator.

In some embodiments, base 20 includes at least an adjusting lug channel 21. The adjusting lug channel is disposed through the base, and is configured for receiving adjusting lug 40. Specifically, the adjusting lug channel 21 includes at least a threaded portion of the adjusting lug channel 22.

In some embodiments, an adjusting lug 40 is configured for mating with the base. The adjusting lug may have a threaded portion of the adjusting lug 41 configured for mating with the threaded portion 22 of the adjusting lug channel 21 of the base 20.

In some embodiments, an adjusting lug 40 also includes an air mixture screw channel 42. The air mixture screw channel is disposed through the adjusting lug, and is coaxially disposed with the adjusting lug channel 21 of the base 20 when adjusting lug is coupled with the base (the coaxial axis being depicted in FIG. 5*b* as C-C). At least a portion of the air mixture screw channel is a threaded portion of the air mixture screw channel 43.

In some embodiments, air mixture screw 50 is configured for mating with the adjusting lug. The air mixture screw may include at least one threaded portion of the air mixture screw 51. The threaded portion of the air mixture screw mates with the threaded portion 43 of the air mixture screw channel 42 of the adjusting lug 40. In some embodiments, the air mixture screw may have a bypass end 52, the bypass end being the portion of the air mixture screw which is disposed within the idle air bypass passage upon the apparatus 10 being installed on a motorcycle throttle body (idle air bypass passage not shown in 5*a*, 5*b* and 5*c* but depicted in FIG. 1 as idle air bypass passage 12). The air mixture screw may extend and retract from apparatus 10. In some embodiments, extension may extend the air mixture screw to a point at 63. In some embodiments, retraction may retract the air mixture screw to a point at 62. Extending and/or retracting the air mixture screw controls the flow of air through the idle air bypass passage.

In some embodiments, the air mixture screw 50 has an adjustment end 53, the adjustment end disposed opposite to the bypass end 52 of the air mixture screw. The adjustment end includes an interface for a hand tool. In some embodiments, the interface may resemble a square nut, a hex nut, a slot for a slotted screwdriver, a Phillips-slot for a Phillips-head screwdriver, or any other interface appropriate for use with a hand tool to rotate the air mixture screw. In some embodiments, a hand tool appropriate for use to rotate the air mixture screw may include a wrench, pliers, channel-lock pliers, nutdriver, screwdriver, socket wrench, needlenose pliers and the like. In some embodiments, the air mixture screw may be adjusted using the hand tool at least two complete rotations within the adjusting lug 40.

In some embodiments, handle 70 is interfaced with the adjusting lug. In some embodiments, the adjusting lug may have a threaded handle channel 44 configured for mating with a threaded end 71 of the handle 70. In some embodiments, the handle 72 may have a grip end 72, the grip end disposed opposite the threaded end 71 of the handle 70. In some embodiments, the grip end may have a hand tool interface of the grip end, enabling a human to rotate the handle into the threaded handle channel using a hand tool. The interface of the grip end may, for example, include a hexagonal socket (as shown in at least FIG. 6*a*) configured for using a socket wrench to rotate the handle into the adjusting lug. The interface and hand tool for the grip end tool interface may include other selections (square nut, hex nut, wrench, pliers, etc.) as disclosed previously with respect to the hand tool interface. In some embodiments, the grip end is adapted for receiving a decorative element. In different embodiments, the grip end is adapted for receiving a knob (decorative element and/or knob not shown). The grip end adapted for receiving a decorative element or knob may in addition to the tool interface include threading the exterior of the grip end of the handle. For example, the threading may include threading for a tire inflation stem cap (a 5/16-32 NF thread for about 3/8 inch from the end). In some embodiments, the handle 70 may be at a perpendicular angle along axis P-P to the coaxial axis about which the air mixture screw and/or the adjusting lug rotate within the base. In a preferred embodiment, the handle may be approximately 20 degrees off the perpendicular axis (represented by angle C-P), wherein approximately could mean up to 10 degree variance in either direction.

In some embodiments, the air mixture screw 50 may be fixed in position relative to the adjusting lug 40 via inserting the threaded end 71 of the handle 70 into the threaded handle channel 44 of the adjusting lug and rotating/tightening the handle 70 within the adjusting lug until it comes into contact with the air mixture screw. The foregoing operating of tightening the handle limits the rotation of the air mixture screw within the adjusting lug by fixedly engaging the air mixture screw with the handle. Therefore, when the handle is moved by hand, rotating the adjusting lug within the base 20, the adjusting lug and air mixture screw move in tandem, varying the extension/retraction of the air mixture screw, which may move between point 62 and point 63 in response to the handle being moved from shoulder 37*a* to shoulder 37*b* for example.

In some embodiments, the handle 70, which is configured for permitting rotation by hand, is limited to less than one rotation of the adjusting lug 40 within the base 20. In a preferred embodiment, the rotation of the handle is limited to approximately 90 degrees of rotation, wherein approximately could mean up to 10 degree variance. The limitation of the handle within the base may be achieved through shoulders 37*a* and 37*b* of the base which limit travel of the handle, as will be disclosed and depicted elsewhere herein.

Figure 6A:
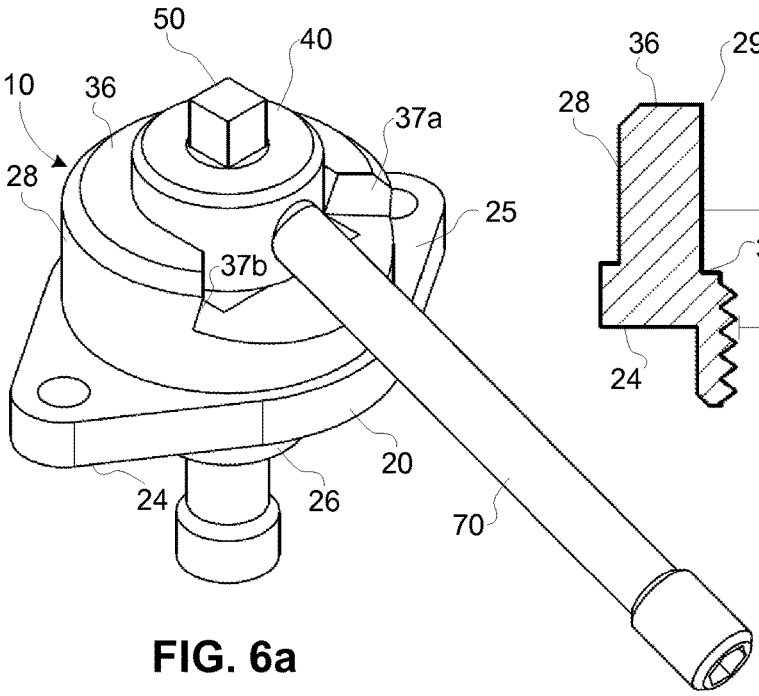
FIG. 6*a* is an isometric view of an apparatus for operator control of motorcycle engine idle, in accordance with an embodiment of the invention.
Figure 6B:
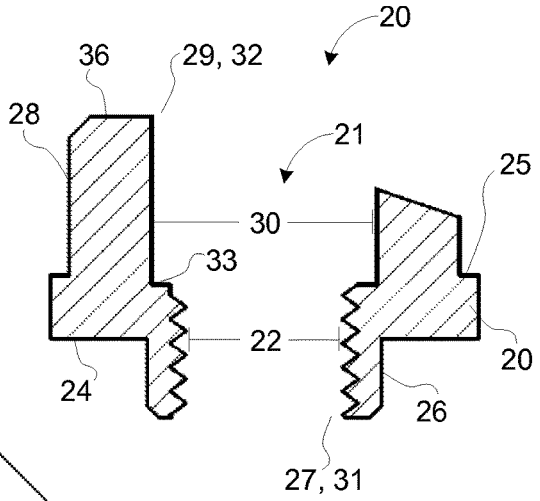
FIG. 6*b* is a cross-sectional view of the base of the apparatus for operator control of motorcycle engine idle, in accordance with an embodiment of the invention.
Figure 6C:
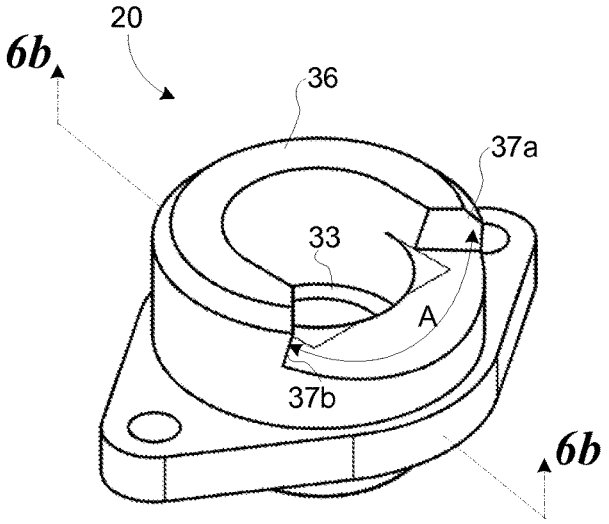
FIG. 6*c* is an isometric view of the base of the apparatus for operator control of motorcycle engine idle, in accordance with an embodiment of the invention.

FIG. 6*a* is an isometric view of an apparatus for operator control of motorcycle engine idle 10, in accordance with an embodiment of the invention. FIG. 6*b* is a cross-sectional view of the base 20 of the apparatus for operator control of motorcycle engine idle, in accordance with an embodiment of the invention. FIG. 6*c* is an isometric view of the base of the apparatus for operator control of motorcycle engine idle, in accordance with an embodiment of the invention. In some embodiments, the base has a bottom surface 24, the bottom surface configured for being placed adjacent to the throttle body (throttle body not shown in FIG. 6*a* or 6*b* but depicted as throttle body 11 in FIG. 1). Opposite the bottom surface is a top surface 25 of the base. The base has a bottom circular collar 26, the bottom circular collar disposed adjacent to the bottom surface of the base. The bottom circular collar includes a bottom aperture of the bottom circular collar at 27. The base also has a top circular collar 28, the top circular collar disposed adjacent to the top surface of the base. The top circular collar includes a top aperture of the top circular collar at 29. As disclosed elsewhere herein, the base includes an adjusting lug channel 21 disposed through the base. With reference to FIG. 6*b*, it may be seen that the adjusting lug channel includes the non-threaded portion 30 of the adjusting lug channel and the threaded portion 22 of the adjusting lug channel. The non-threaded portion of the adjusting lug channel has a top aperture 32 of the non-threaded portion of the adjusting lug channel, the top aperture 32 being collocated with the top aperture 29 of the top circular collar. The threaded portion of the adjusting lug channel has a bottom aperture 31 of the threaded portion of the adjusting lug channel, the bottom aperture 31 being collocated with the bottom aperture 27 of the bottom circular collar. It will also be seen that the non-threaded portion of the adjusting lug channel has a diameter greater than the diameter of the threaded portion, and that the non-threaded and threaded portions meet at a shelf portion 33 of the adjusting lug channel. The shelf portion of the adjusting lug channel defines a limit for the rotation of the adjusting lug within the adjusting lug channel. With reference to FIG. 6*c*, arrow A depicts an arcuate portion of the top circular collar which is cut away from the top circular collar. Cutting away the arcuate portion of the top circular collar results in the top circular collar including a C-shaped region 36 of the top-circular collar. The C-shaped region has two ends, the ends defining shoulders 37*a* and 37*b* disposed at opposite ends of the C-shaped region. Returning to FIG. 6*a*, it may be seen that the two shoulders limit the rotation of the handle 70 (and thus, rotation of the adjusting lug 21 with the air mixture screw 50 fixedly coupled with the adjusting lug) to less than one rotation. In a preferred embodiment, the arcuate cut-away portion is approximately 90 degrees of the top circular collar.

Figure 7A:
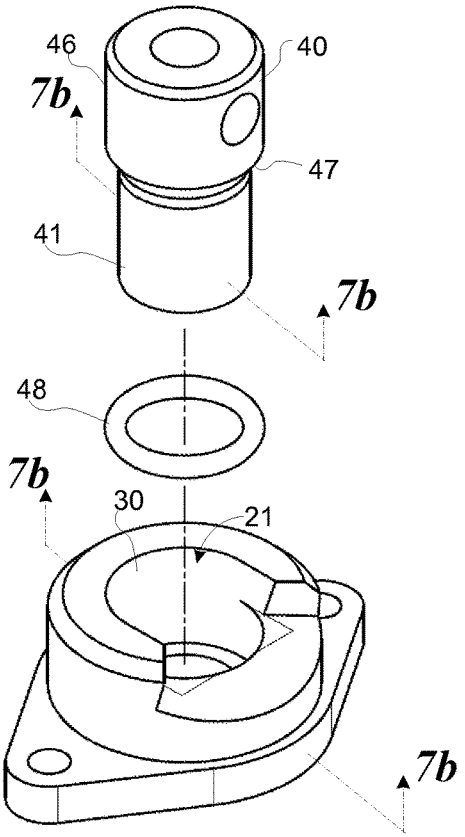
FIG. 7*a* is an isometric exploded view of a base and adjusting lug of an apparatus for operator control of motorcycle engine idle, in accordance with an embodiment of the invention.
Figure 7B:
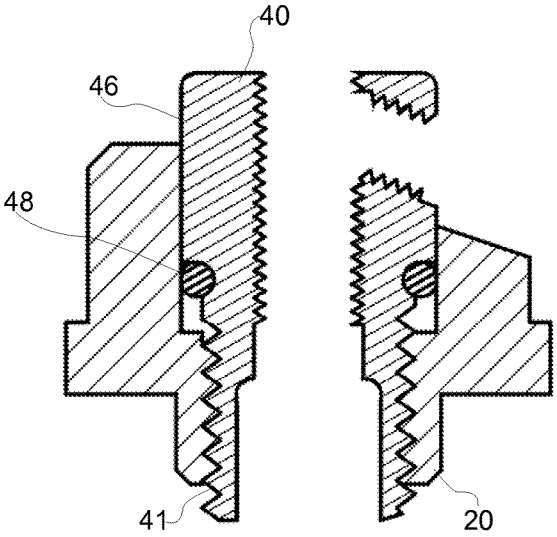
FIG. 7*b* is a cross-sectional view of the base and adjusting lug of the apparatus for operator control of motorcycle engine idle, in accordance with an embodiment of the invention.

FIG. 7*a* is an isometric exploded view of a base and adjusting lug of an apparatus for operator control of motorcycle engine idle, in accordance with an embodiment of the invention. FIG. 7*b* is a cross-sectional view of the base and adjusting lug of the apparatus for operator control of motorcycle engine idle, in accordance with an embodiment of the invention. (FIGS. 7*a* and 7*b* depict the same embodiment including the aforementioned two elements; however, threads are not depicted on the components in FIG. 7*a* for extra visibility of the figure. Threads are shown on the components in the cross-sectional view in FIG. 7*b* and should be understood to be a part of the components in FIG. 7*a*.) In some embodiments, an adjusting lug 40 of the apparatus 10 may include a non-threaded portion 46 of the adjusting lug. The non-threaded portion of the adjusting lug joins the threaded portion 41 of the adjusting lug at a shelf portion 47 of the adjusting lug. When the adjusting lug is threaded into the adjusting lug channel 21 of the base 20, the non-threaded portion of the adjusting lug is at least partially disposed within the non-threaded portion 30 of the adjusting lug channel of the base. In some embodiments, an adjusting lug o-ring 48 is disposed around the threaded portion of the adjusting lug. The adjusting lug o-ring may be disposed adjacent to the shelf portion of the adjusting lug. The adjusting lug o-ring may provide some resistance and/or act as a seal preventing air from escaping the throttle body between the base and adjusting lug. The adjusting lug o-ring may also prevent the adjusting lug from being over-tightened within the base by acting as a barrier between the shelf portion of the adjusting lug and the shelf portion of the adjusting lug channel of the base. Consequently, in some embodiments, the shelf of the adjusting lug encounters the adjusting lug o-ring and the shelf of the adjusting lug channel of the base to limit the rotation of the adjusting lug within the adjusting lug channel of the base.

Figure 8A:
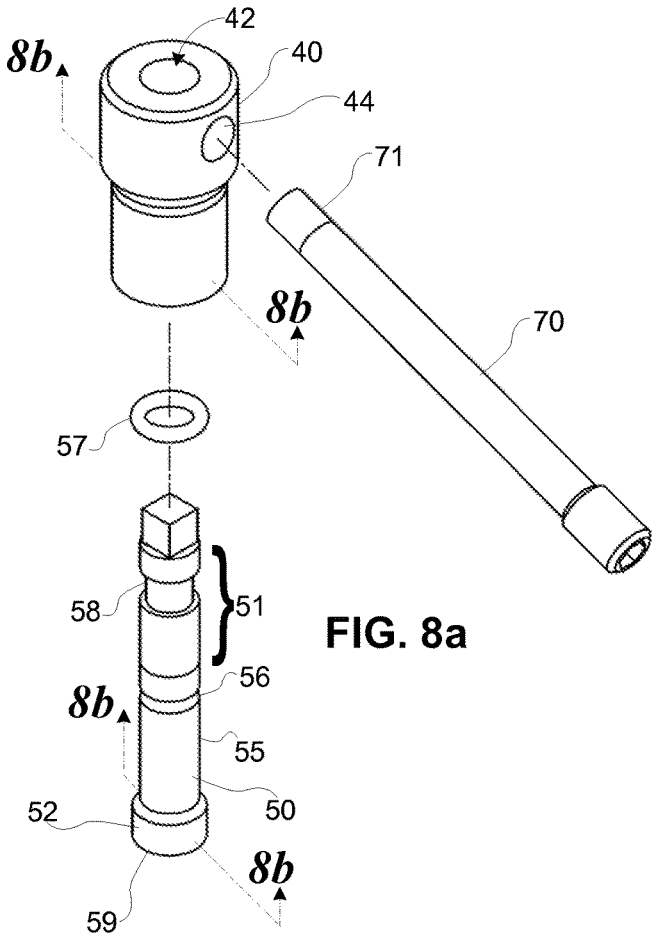
FIG. 8*a* is an isometric exploded view of an adjusting lug, an air mixture screw and a handle of an apparatus for operator control of a motorcycle engine idle, in accordance with an embodiment of the invention.
Figure 8B:
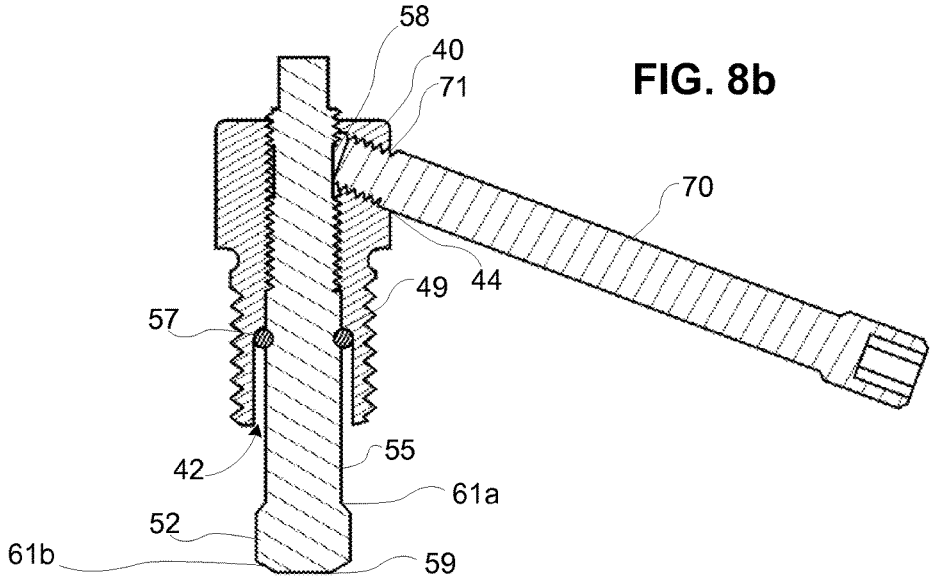
FIG. 8*b* is a cross-sectional view of the adjusting lug, air mixture screw and handle of the apparatus for operator control of a motorcycle engine idle, in accordance with an embodiment of the invention.

FIG. 8*a* is an isometric exploded view of an adjusting lug, an air mixture screw and a handle of an apparatus for operator control of a motorcycle engine idle, in accordance with an embodiment of the invention. FIG. 8*b* is a cross-sectional view of the adjusting lug, air mixture screw and handle of the apparatus for operator control of a motorcycle engine idle, in accordance with an embodiment of the invention. (FIGS. 8*a* and 8*b* depict the same embodiment including the aforementioned three elements; however, threads are not depicted on the components in FIG. 8*a* for extra visibility of the figure. Threads are shown on the components in the cross-sectional view in FIG. 8*b* and should be understood to be a part of the components in FIG. 8*a*.) In some embodiments, an air mixture screw 50 includes at least a non-threaded portion 55, the non-threaded portion disposed between the threaded portion 51 of the air mixture screw and the bypass end 52 of the air mixture screw. The non-threaded portion may have a limit portion 56 disposed within the non-threaded portion. In some embodiments, the limit portion comprises a rounded channel cut into the non-threaded portion of the air mixture screw, the channel surrounding a circumference of the shaft of the air mixture screw. In some embodiments, an air mixture screw o-ring 57 is disposed within the limit portion 56 (i.e. in the channel cut into the shaft of the air mixture screw). The limit portion defines a limit for the rotation of the air mixture screw within the air mixture screw channel 42 of the adjusting lug 40. Particularly, when the air mixture screw is rotated into the air mixture screw channel of the adjusting lug, the o-ring disposed within limit portion of the air mixture screw encounters an interior shelf portion of the adjusting lug 49. The air mixture screw o-ring may provide some resistance and/or act as a seal preventing air from escaping the throttle body between the adjusting lug and the air mixture screw. The air mixture screw o-ring may also prevent the air mixture screw from being over-tightened within the adjusting lug by acting as a barrier between the interior shelf portion of the adjusting lug and the limit portion of the air mixture screw.

In some embodiments, an air mixture screw 50 may include an interior region 58 of the threaded portion 51 of the air mixture screw. At least a portion of the threads may be removed from this interior region of the threaded portion. Accordingly, when the handle 70 is threaded into the threaded handle channel 44 of the adjusting lug 40, threaded end 71 of the handle will encounter the interior region of the threaded portion of the air mixture screw, the interior region having had the threads removed. Tightening the handle will fixedly couple the handle with the air mixture screw. Consequently, as disclosed elsewhere herein, when the handle is engaged by hand and rotated (as shown in at least FIG. 4*a*), the adjusting lug and air mixture screw will rotate in tandem, changing the extension/retraction of the air mixture screw within the throttle body. In some embodiments, the bypass end 52 of the air mixture screw includes a tip 59, the tip including at least a larger diameter than an adjacent portion of the air mixture screw (which may be the non-threaded portion 55 of the air mixture screw). In some embodiments, the tip of the air mixture screw includes at least a flared portion of the tip. In some embodiments, more than one flared portion may couple the tip with the non-threaded portion of the air mixture screw. The tip may include a flared portion 61*a* as the transition from the non-threaded portion to the bypass end, and include a flared portion 61*b* as the transition to the flat surface at the end of the bypass end. In different embodiments, the tip may be differently shaped. For example, the tip may have a flat surface, or any surface of the tip may be curved, jagged, concave, convex, irregularly-shaped, have other texture or have one or more channels through the tip as needed to alter a sound profile of the internal combustion engine. For example, a flat end of the tip with flared transitions to the end may provide a smooth rumble, whereas an irregularly-textured end of the tip may provide a rough staccato-like engine sound.

Figure 9A:
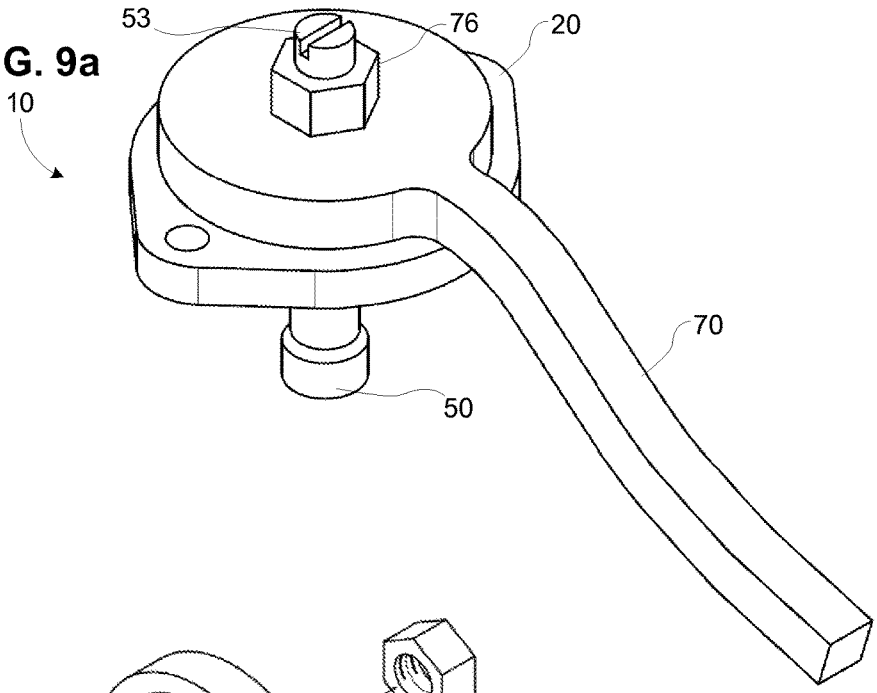
FIGS. 9*a* and 9*b* are an isometric view and a partially exploded view of an apparatus for operator control of motorcycle engine idle, in accordance with an embodiment of the invention.
Figure 9B:
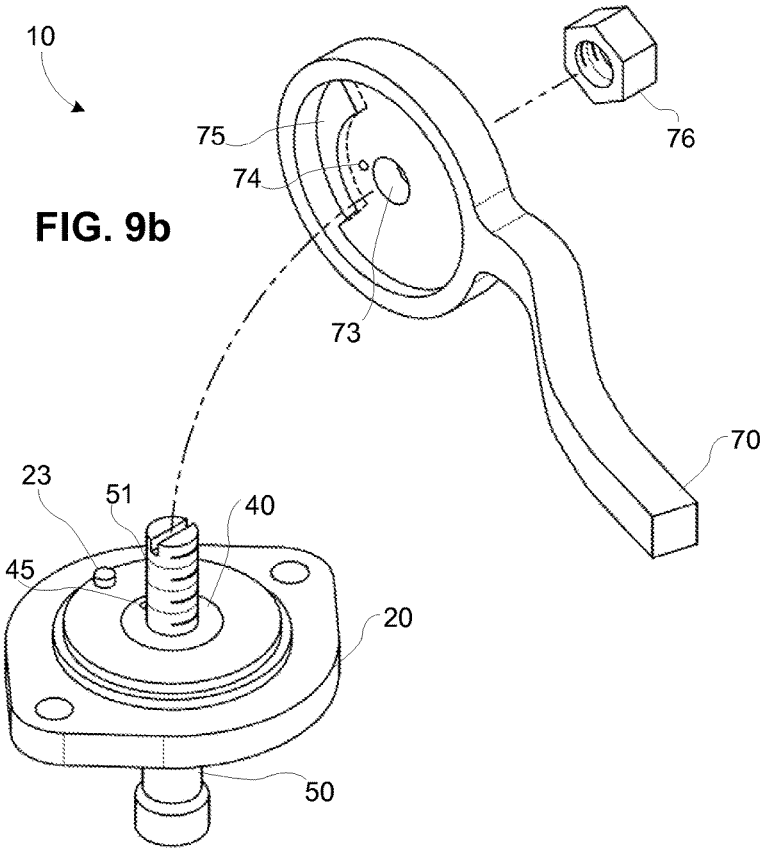

FIGS. 9*a* and 9*b* are an isometric view and a partially exploded view of an apparatus for operator control of motorcycle engine idle, in accordance with an embodiment of the invention. FIGS. 9*c* and 9*d* are top plan views of an apparatus for operator control of motorcycle engine idle, in accordance with an embodiment of the invention. In some embodiments, the apparatus for operator control of motorcycle engine idle comprises a manually-adjustable idle air control 10. In some embodiments, the manually-adjustable idle air control includes a base 20, an adjusting lug 40, and air mixture screw 50 and a handle 70. In some embodiments, the adjusting lug includes at least a handle-interfacing post 45, the handle-interfacing post disposed on a top surface of the adjusting lug. The handle 70 may include at least a center aperture 73 of the handle, wherein a threaded portion 51 of the air mixture screw adjustment end is disposed through the center aperture of the handle. The handle may further include at least a dimple 74 disposed on a bottom surface of the handle, the dimple engaging the handle-interfacing post of the adjusting lug. During assembly, a nut 76 is threaded onto the threaded portion of the air mixture screw adjustment end, which fixedly couples the handle and adjusting lug. The engagement of the dimple of the handle with the handle-interfacing post of the adjusting lug when the handle is coupled with the apparatus facilitates the movement of the adjusting lug when the handle is turned. Tightening the nut against the handle also engages the air mixture screw 50, so that when the handle is rotated, the air mixture screw rotates in tandem with the handle and the adjusting lug. Consequently, rotating the handle about a lengthwise axis through the air mixture screw extends and retracts the air mixture screw from the apparatus, as disclosed elsewhere herein. In some embodiments, the base includes at least a roll pin 23 disposed on a top surface of the base, and the handle includes at least an arcuate hollow 75 disposed on a bottom surface of the handle. During assembly, the roll pin engages the handle within the arcuate hollow of the handle. As may be seen in FIGS. 9*c* and 9*d*, when the handle is rotated, the roll pin within the arcuate hollow limits rotation of the handle to less than one rotation of the adjusting lug within the base (the "minor adjustment" range). (In the top plan views depicted in FIGS. 9*c* and 9*d*, dashed outlines indicate the details which are on the underside of the handle, and dashed lead lines have been used between the reference characters and the details to which the reference characters refer.) As has been disclosed elsewhere herein, including at least discussion related to FIG. 5*b*, the air mixture screw has an adjustment end 53, the adjustment end including an interface for a hand tool. In some embodiments, the interface for a hand tool may include a slot for a slotted screwdriver. Using a slotted screwdriver, the air mixture screw may be rotated at least two complete rotations within the adjusting lug (the "major adjustment" range).

Figure 10:
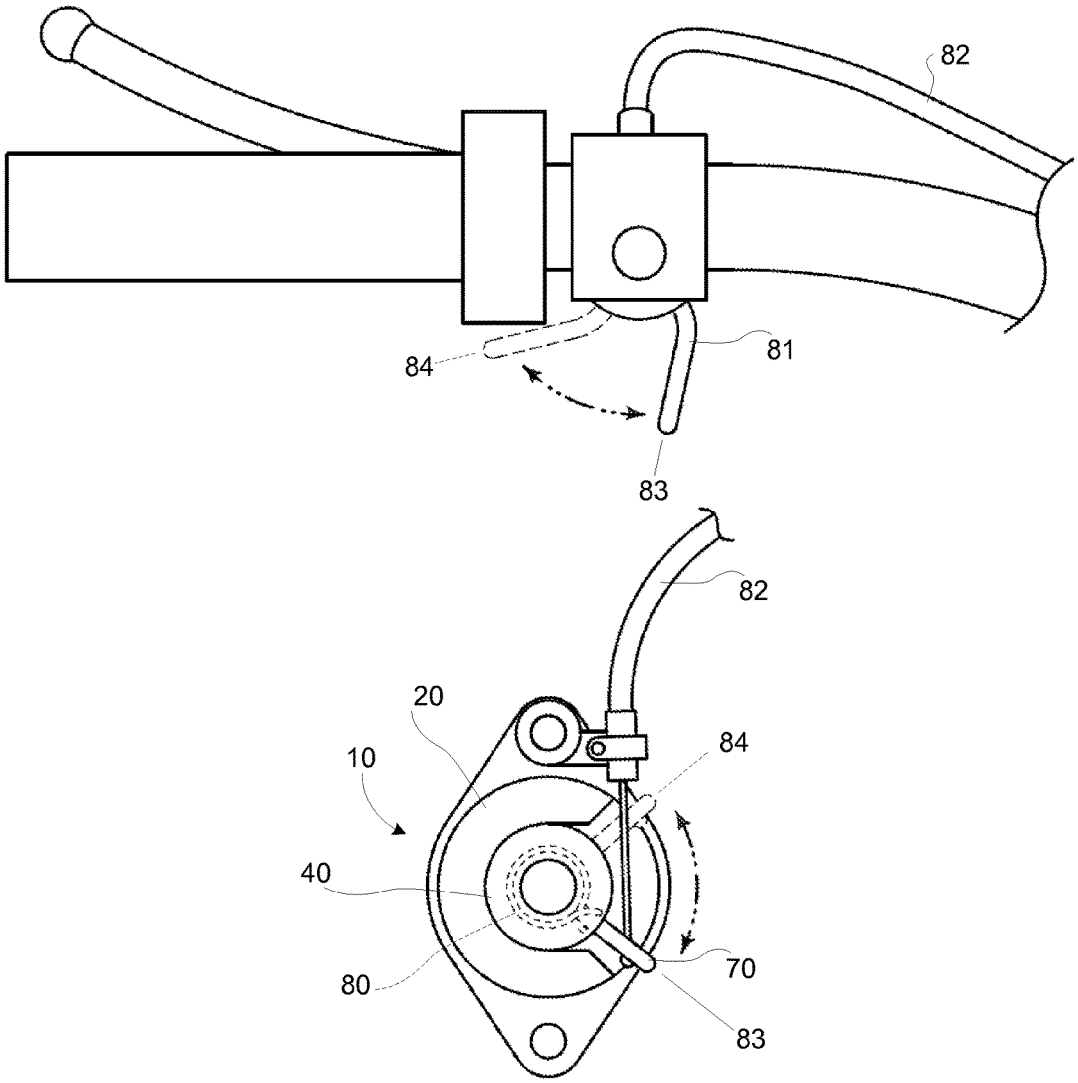
FIG. 10 is a top view of an apparatus for operator control of motorcycle engine idle, in accordance with an embodiment of the invention.

FIG. 10 is a top view of an apparatus for operator control of motorcycle engine idle, in accordance with an embodiment of the invention. In some embodiments, the apparatus for operator control of motorcycle engine idle comprises a manually-adjustable idle air control 10, and further comprises at least a torsion return spring 80, a handlebar control 81, and a cable 82. In some embodiments, the torsion return spring is disposed coaxially about the apparatus 10, including being wound around the adjusting lug 40. The torsion return spring is fixedly coupled to the base 20 and the handle 70, tensionally biasing the handle and the adjusting lug in a first position of the idle air control valve at 83. In some embodiments, the first position is at one end of the minor adjustment range, for example, including where the air mixture screw (air mixture screw not pictured in FIG. 10 for enhanced visibility) is in an extended position, restricting the flow of air through the throttle body (a "slow idle" position). In some embodiments, a handlebar control 81 is disposed on a handlebar of the motorcycle, with the cable 82 being disposed through the handlebar control and being coupled with the handle. Applying hand pressure to the handlebar control pulls the cable coupled with the handle, rotating the adjusting lug and air mixture screw in tandem to a second position of the idle air control valve at 84. In some embodiments, the second position is at the other end of the minor adjustment range, for example, including where the air mixture screw is in a retracted position, increasing the flow of air through the throttle body (a "fast idle" position). Releasing hand pressure from the handlebar control releases the cable coupled with the handle, and the torsion return spring tensionally biasing the handle and adjusting lug tending to return the handle and adjusting lug to the first position.

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A manually-adjustable idle air control valve for a motorcycle, comprising:

a base, the base including at least an adjusting lug channel, the adjusting lug channel disposed through the base including at least a threaded portion of the adjusting lug channel;

an adjusting lug, the adjusting lug including at least:

a threaded portion of the adjusting lug mating with the threaded portion of the adjusting lug channel of the base, the threaded portion of the adjusting lug including at least a first thread size; and an air mixture screw channel disposed through the adjusting lug and coaxially disposed with the adjusting lug channel of the base, the air mixture screw channel including at least a threaded portion of the air mixture screw channel;

an air mixture screw, the air mixture screw including at least:

a threaded portion of the air mixture screw mating with the threaded portion of the air mixture screw channel of the adjusting lug, the threaded portion of the air mixture screw including at least a second thread size;

a bypass end; and an adjustment end opposite the bypass end, the adjustment end including at least an interface for a hand tool; and a handle, the handle interfaced with the adjusting lug, wherein the first thread size and the second thread size facilitate at least a coarse adjustment and a fine adjustment of the air mixture screw.

2. The manually-adjustable idle air control valve of claim 1, wherein the air mixture screw adjustment end comprises:

an air mixture screw adjustment end including at least an interface for a hand tool, the interface for a hand tool enabling the air mixture screw to be rotated within the adjusting lug using a hand tool, the interface for a hand tool permitting at least two complete rotations of the air mixture screw within the adjusting lug; and wherein the handle interfaced with the adjusting lug comprises:

a handle interfaced with the adjusting lug enabling the adjusting lug to be rotated within the base by hand, the handle limited to less than one rotation of the adjusting lug within the base.

3. The manually-adjustable idle air control valve of claim 2, wherein the adjusting lug comprises:

a threaded handle channel disposed through a side of the adjusting lug, and wherein the handle interfaced with the adjusting lug comprises:

a threaded end, the threaded end of the handle mating with the threaded handle channel of the adjusting lug; and a grip end, the grip end opposite the threaded end, the grip end including at least the interface for a hand tool, wherein the handle limits the rotation of the air mixture screw within the adjusting lug upon threading the handle through the threaded handle channel of the adjusting lug until the handle fixedly engages the air mixture screw.

4. The manually-adjustable idle air control of claim 2, wherein the adjusting lug comprises:

a handle-interfacing post, the handle interfacing post disposed on a top surface of the adjusting lug;

wherein the handle interfaced with the adjusting lug comprises:

a center aperture of the handle, wherein a threaded portion of the air mixture screw adjustment end is disposed through the center aperture of the handle;

a dimple disposed on a bottom surface of the handle, the dimple engaging the handle-interfacing post of the adjusting lug; and an arcuate hollow on the bottom surface of the handle; and wherein a nut threaded onto the threaded portion of the air mixture screw adjustment end fixedly couples the handle and adjusting lug and engages the arcuate hollow with a roll pin disposed on a top surface of the base, the roll pin and arcuate hollow limiting rotation of the handle to less than one rotation of the adjusting lug within the base.

5. The manually-controllable idle air control valve of claim 2, wherein the base comprises:

a bottom surface of the base;

a top surface of the base;

a bottom circular collar disposed adjacent to the bottom surface of the base, the bottom circular including at least a bottom aperture of the bottom circular collar; and a top circular collar disposed adjacent to the top surface of the base, the top circular collar including at least a top aperture of the top circular collar, wherein the adjusting lug channel is coaxially disposed through the top circular collar, the base, and the bottom circular collar, the adjusting lug channel including:

the threaded portion of the adjusting lug channel including at least a bottom aperture collocated with the bottom aperture of the bottom circular collar; and a non-threaded portion of the adjusting lug channel, the non-threaded portion of the adjusting lug channel including at least a top aperture collocated with the top aperture of the top circular collar, wherein the non-threaded portion of the adjusting lug channel has a diameter greater than a diameter of the threaded portion, the threaded portion and non-threaded portion joined at a shelf portion of the adjusting lug channel, the shelf portion defining a limit for the rotation of the adjusting lug within the adjusting lug channel.

6. The manually-controllable idle air control valve of claim 5, wherein the top circular collar disposed adjacent to the top surface of the base comprises:

a top circular collar disposed adjacent to the top surface of the base, wherein at least an arcuate portion of the top circular collar is cut away defining a C-shaped region of the top circular collar, the C-shaped region of the top circular collar defining two shoulders disposed at opposite ends of the C-shaped region, the two shoulders limiting rotation of the handle to less than one rotation.

7. The manually-controllable idle air control valve of claim 5, wherein the adjusting lug comprises:

a non-threaded portion of the adjusting lug, the non-threaded portion of the adjusting lug and the threaded portion of the adjusting lug joined at a shelf portion of the adjusting lug, wherein the non-threaded portion of the adjusting lug is at least partially disposed within the non-threaded portion of the adjusting lug channel when the adjusting lug is threaded into the adjusting lug channel of the base, wherein an adjusting lug o-ring is disposed around the threaded portion of the adjusting lug adjacent to the shelf portion of the adjusting lug, and wherein the shelf of the adjusting lug encounters the adjusting lug o-ring and the shelf of the adjusting lug channel of the base to limit the rotation of the adjusting lug within the adjusting lug channel of the base.

8. The manually-controllable idle air control valve of claim 5, wherein the air mixture screw comprises:

a non-threaded portion disposed between the threaded portion and the bypass end;

a limit portion disposed within a region of the non-threaded portion, the limit portion comprising a rounded channel disposed about the air mixture screw; and an air mixture screw o-ring disposed within the limit portion, the limit portion defining a limit for the rotation of the air mixture screw within the air mixture screw channel of the adjusting lug.

9. The manually-controllable idle air control valve of claim 8, wherein the threaded portion of the air mixture screw comprises:

the threaded portion of the air mixture screw including at least a portion of the threads removed from an interior region of the threaded portion.

10. The manually-adjustable idle air control valve of claim 1, wherein the bypass end of the air mixture screw comprises:

a bypass end of the air mixture screw including at least a tip, the tip comprising a portion of the bypass end with a larger diameter than an adjacent portion of the air mixture screw, wherein at least a portion of the tip is a flat surface.

11. The manually-adjustable idle air control valve of claim 1, wherein the tip of the air mixture screw includes at least a flared portion of the tip.

12. The manually-controllable idle air control valve of claim 8, wherein the air mixture screw o-ring disposed around the non-threaded portion of the air mixture screw at least substantially contacts an interior portion of the air mixture screw channel of the adjusting lug around a circumference of the interior portion of the air mixture screw channel, and wherein the adjusting lug o-ring disposed around the threaded portion of the adjusting lug at least substantially contacts an interior region of the adjusting lug channel of the base around a circumference of the interior portion of the adjusting lug channel.

13. The manually-controllable idle air control valve of claim 1, further comprising:

a torsion return spring, the torsion return spring wound around the adjusting lug, the torsion return spring coupled to the handle and the base and tensionally biasing the handle and adjusting lug in a first position of the idle air control valve;

a handlebar control; and a cable disposed through the handlebar control and coupled with the handle, wherein applying hand pressure to the handlebar control pulls the cable coupled with the handle to rotate the adjusting lug to a second position of the idle air control valve, and wherein releasing hand pressure from the handlebar control releases the cable coupled with the handle, the torsion return spring tensionally biasing the handle and adjusting lug to the first position of the idle air control valve.

14. The manually-adjustable idle air control valve for a motorcycle of claim 1, wherein the handle comprises:

the handle enabling a human to vary a range of the idle air control valve by hand.

15. The manually-adjustableidle air control valve for a motorcycle of claim 1, wherein the handle comprises:

the handle enabling a human to vary a range of the idle air control valve while astride the motorcycle.

16. The manually-adjustable idle air control valve for a motorcycle of claim 1, wherein the adjustment end including at least an interface for a hand tool comprises:

the adjustment end including at least an interface for a hand tool enabling a human to at least partially vary a range of the idle air control valve with the hand tool.

17. The manually-adjustable idle air control valve for a motorcycle of claim 1, further comprising:

the manually-adjustable idle air control valve for a motorcycle configured for varying idle air through the idle air control valve without command of the idle air control valve by an engine control unit ("ECU") of the motorcycle.

18. A two-way maually-adjustable idle air control valve for a motorcycle, comprising:

a base, the base including at least an adjusting lug channel, the adjusting lug channel disposed through the base including at least a threaded portion of the adjusting lug channel;

an adjusting lug, the adjusting lug including at least:

a threaded portion of the adjusting lug mating with the threaded portion of the adjusting lug channel of the base, the threaded portion of the adjusting lug including at least a first thread size; and an air mixture screw channel disposed through the adjusting lug and coaxially disposed with the adjusting lug channel of the base, the air mixture screw channel including at least a threaded portion of the air mixture screw channel;

an air mixture screw, the air mixture screw configured for interfacing with a hand tool, the air mixture screw including at least a threaded portion of the air mixture screw mating with the threaded portion of the air mixture screw channel of the adjusting lug, the threaded portion of the air mixture screw including at least a second thread size; and a handle, the handle interfaced with the adjusting lug, wherein the first thread size and the second thread size facilitate at least a coarse adjustment and a fine adjustment of the air mixture screw.

19. A two-way manually-adjustable idle air control valve for a motorcycle, comprising:

a base;

an adjusting lug threadably disposed through a channel in the base at least partially using threads of a first thread size;

an air mixture screw threadably disposed through a channel in the adjusting lug at least partially using threads of a second thread size, the air mixture screw configured for receiving a hand tool for adjustment of the air mixture screw; and a handle interfaced with the adjusting lug, the handle configured for rotating the adjusting lug within the base for adjustment of the air mixture screw, wherein the first thread size and the second thread size facilitate at least a coarse adjustment and a fine adjustment of the air mixture screw.

20. The two-way manually-adjustable idle air control valve for a motorcycle of claim 19, wherein the handle interfaced with the adjusting lug comprises:

the handle interfaced with the adjusting lug enabling an operator of the motorcycle to at least partially vary a range of the idle air control valve by hand while astride the motorcycle.

21. The two-way manually-adjustable idle air control valve for a motorcycle of claim 19, further comprising:

the two-way manually-adjustable idle air control valve for a motorcycle configured for varying idle air through the idle air control valve without command of the idle air control valve by an ECU of the motorcycle.

* * * * *